United States Patent [19]

Tovey

[11] Patent Number: 4,757,743

[45] Date of Patent: Jul. 19, 1988

[54] POWER TRANSMISSION

[75] Inventor: Peter Tovey, Jackson, Miss.

[73] Assignee: Vickers, Incorporated, Troy, Mich.

[21] Appl. No.: 44,041

[22] Filed: Apr. 29, 1987

[51] Int. Cl.[4] ..... F01B 13/00; F01B 13/04

[52] U.S. Cl. ..... 91/6.5; 91/506

[58] Field of Search ..... 91/6.5, 499, 506

[56] References Cited

U.S. PATENT DOCUMENTS

| | | | |
|---|---|---|---|
| 2,963,983 | 12/1960 | Wiggermann | 91/6.5 |
| 3,157,130 | 11/1964 | Cardiou | 91/6.5 |
| 3,199,461 | 8/1965 | Wolf | 91/6.5 |
| 3,858,483 | 1/1975 | Hein | 91/6.5 |
| 3,956,969 | 5/1976 | Hein | 91/6.5 |
| 4,048,903 | 9/1977 | Roberts | 91/6.5 |
| 4,175,472 | 11/1979 | Roberts | 91/6.5 |

FOREIGN PATENT DOCUMENTS

| | | | |
|---|---|---|---|
| 48508 | 8/1985 | Japan | 91/499 |
| 663308 | 7/1979 | U.S.S.R. | 91/499 |

*Primary Examiner*—William L. Freeh

*Attorney, Agent, or Firm*—Barnes, Kisselle, Raisch, Choate, Whittemore & Hulbert

[57] ABSTRACT

A rotary hydraulic machine which includes a housing having a shaft mounted for rotation within the housing about a shaft axis. A cylinder block is coupled to the shaft for corotation with the shaft within the housing and includes a plurality of cylinders disposed in a circumferential array parallel to and surrounding the shaft axis. A piston is disposed to reciprocate within each of the cylinders and is coupled to a yoke for determining displacement of the pistons within the cylinders. A valve plate is affixed within the housing and includes arcuate slots at a radius from the axis of rotation corresponding to that of the cylinders. The slots respectively connect cylinders to the machine inlet and outlet ports as the cylinders register with the slots. In accordance with a distinguishing feature which characterizes one aspect of the present invention, the valve plate also includes first and second pressure valves respectively mounted on the plate adjacent to leading edges of the arcuate slots (with respect to the direction of cylinder rotation) and responsive to fluid pressure for porting the cylinders to the adjacent slots and thereby, in effect, extending the arcuate dimension of the slots and altering machine timing as a function of fluid pressure.

7 Claims, 5 Drawing Sheets

POWER TRANSMISSION

The present invention is directed to rotary hydraulic machines, and more particularly to port timing of rotary axial-piston hydraulic pumps and motors.

For purposes of convenience, the invention will be described in conjunction with a presently preferred implementation thereof embodied in an inline variable displacement piston pump. It will be understood, however, that the principles of the invention apply equally as well to so-called bent axis piston pumps, as well as to hydraulic motors of analogous structure.

BACKGROUND AND OBJECTS OF THE INVENTION

Conventional inline variable displacement piston pumps of the subject type comprise a case or housing within which a cylinder block is coupled to a rotatable drive shaft. The cylinder block contains a plurality of cylinder cavities disposed in a circumferential array surrounding the shaft axis. A corresponding plurality of pistons are slidably positioned within the respective cylinders. The pistons engage a yoke cam which is variably positionable within the pump housing for collectively adjusting stroke or displacement of the pistons within the cylinders. The cylinder block rotates against a valve plate having arcuate inlet and outlet kidney-shaped slots which serve in a well-known manner to provide properly phased or timed communication between the end ports of the cylinder bores within which the pistons reciprocate and inlet and outlet passages and ports in the pump housing.

Timing of the hydraulic pump by circumferential positioning of the slot ends in the valve plate involves matching pump cylinder pressures to inlet and outlet passage pressures at the angular position at which the cylinder begins to communicate through the slot with the inlet and outlet ports. Thus, pump timing is conventionally optimized for only one set of operating conditions—i.e., one design combination of inlet and outlet pressures, pump speed, fluid flow, fluid temperature and fluid type. Deviation from these optimum or design conditions creates under compression or over compression of fluid in the cylinder block, causing high fluid velocities at edges of the timing slots, noise, fluid cavitation, pump wear and flow oscillations resulting in pressure ripple. All of these effects are undesirable in controlled hydraulic circuits.

It has been normal practice to operate a pump at constant pressure conditions by varying pump displacement. However, microprocessor-based control systems provide facility for enhanced control in a plurality of otherwise desirable pump operating modes, such as constant flow and constant power modes. However, pump timing is not optimum for conditions which depart from the pump design conditions, resulting in the various problems noted above.

A general object of the present invention is to provide a rotary hydraulic machine, such as an inline variable displacement piston pump, in which pump port timing varies with operating conditions. A more specific object of the invention is to provide a machine of the described character in which timing is optimized for two sets of operating conditions, specifically high and low output pressure conditions. Thus, a yet more specific object of the invention is to provide dual pressure timing for axial-piston rotary hydraulic machines such as variable displacement piston pumps.

SUMMARY OF THE INVENTION

In accordance with the present invention, a rotary hydraulic machine includes a housing having a shaft mounted for rotation about a shaft axis within the housing. A cylinder block is coupled to the shaft for corotation with the shaft within the housing and includes at least one cylinder, and preferably a plurality of cylinders, disposed in a circumferential array parallel to and surrounding the shaft axis. A piston is disposed to reciprocate within each of the cylinders and is coupled to a yoke for determining displacement of the pistons within the cylinders. A valve plate is affixed within the housing for facing engagement with the rotating cylinder block. The valve plate includes arcuate slots at a radius from the axis of rotation corresponding to that of the cylinders and respectively connecting cylinders to the machine inlet and outlet ports as the cylinders register with the slots.

In accordance with a distinguishing feature which characterizes one aspect of the present invention, the valve plate includes first and second pressure valves respectively mounted on the plate adjacent to the arcuate slots and responsive to fluid pressure for porting the cylinders to the adjacent slots and thereby, in effect, extending the arcuate dimension of the slots and altering machine timing as a function of fluid pressure. In the preferred embodiment of the invention, and as applied specifically to dual-pressure timing of an inline variable displacement piston pump, the pressure valves are mounted within the valve plate adjacent to respective leading edges of the first and second slots with respect to a predetermined direction of shaft and cylinder block rotation so as to effectively advance and retard timing of the pump as a function of pump output pressure. Each pressure valve comprises a valve spool positioned within an associated radial bore and having a spool waist for selectively connecting valve passages extending from the bore to the cylinder-engaging face of the valve plate and to the adjacent plate slot. A pilot passage extends from the inner end of each bore to the plate slot associated with the pump fluid outlet port, and a coil spring is captured in compression between the plate and the outer end of each valve spool. The valve plate is mounted within the pump housing in a cavity containing fluid at case pressure, and the valve spring are captured within the plate by a keeper having a damping orifice through which fluid may flow at case pressure to and from the spring cavity.

In accordance with another important aspect of the present invention, the rotary machine housing includes first and second housing sections affixed to each other to form the internal cavity at case fluid pressure within which the cylinder block and yoke are disposed. At least one fluid passage extends through the interface between the housing sections. In particular, in the preferred embodiment which comprises a variable displacement pump, yoke position is controlled by an actuator piston which receives fluid at controlled pressure through a passage which extends across the housing section interface. At the interface, such passage takes the form of a cylindrical cavity composed of opposed half-cavity recesses in the respective housing sections connected by fluid passages to receive fluid at case pressure. Inwardly oriented annular channels are formed in each housing section and open into the associated cavity half-section midway between the housing section interface and the cavity base. The metered fluid passages to the actuator piston terminate in the respective channels. A hollow sleeve is captured within the cylindrical cavity and has outwardly facing annular channels in registry with the inwardly facing channels of the housing sections, and a passage which connects the outwardly facing channels and thereby feeds fluid at metered pressure to the yoke actuator piston. Sealing rings are carried by the sleeve.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1A:
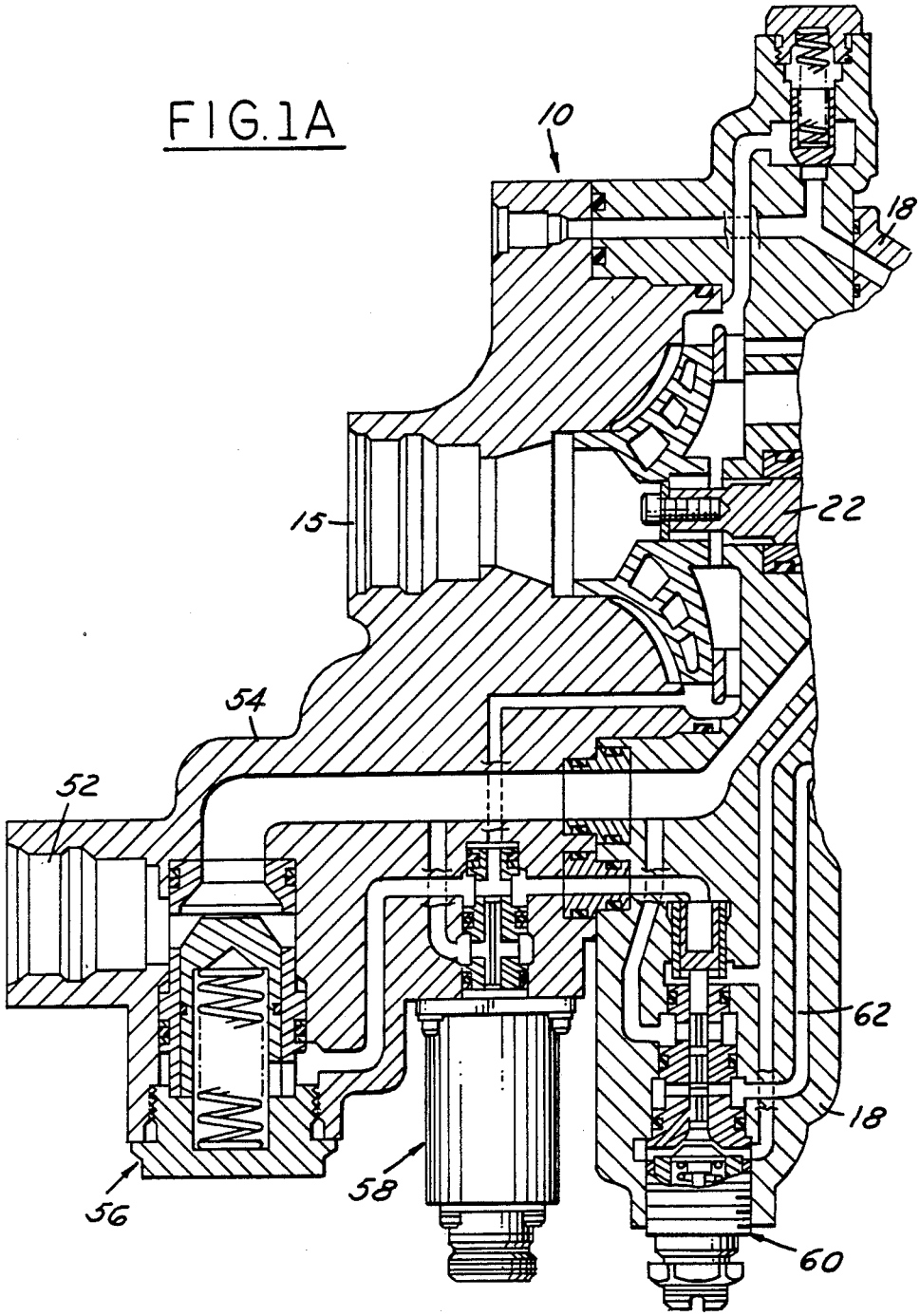
FIGS. 1A and 1B together comprise a sectional view in side elevation of an inline variable displacement piston pump embodying the present invention.
Figure 1B:
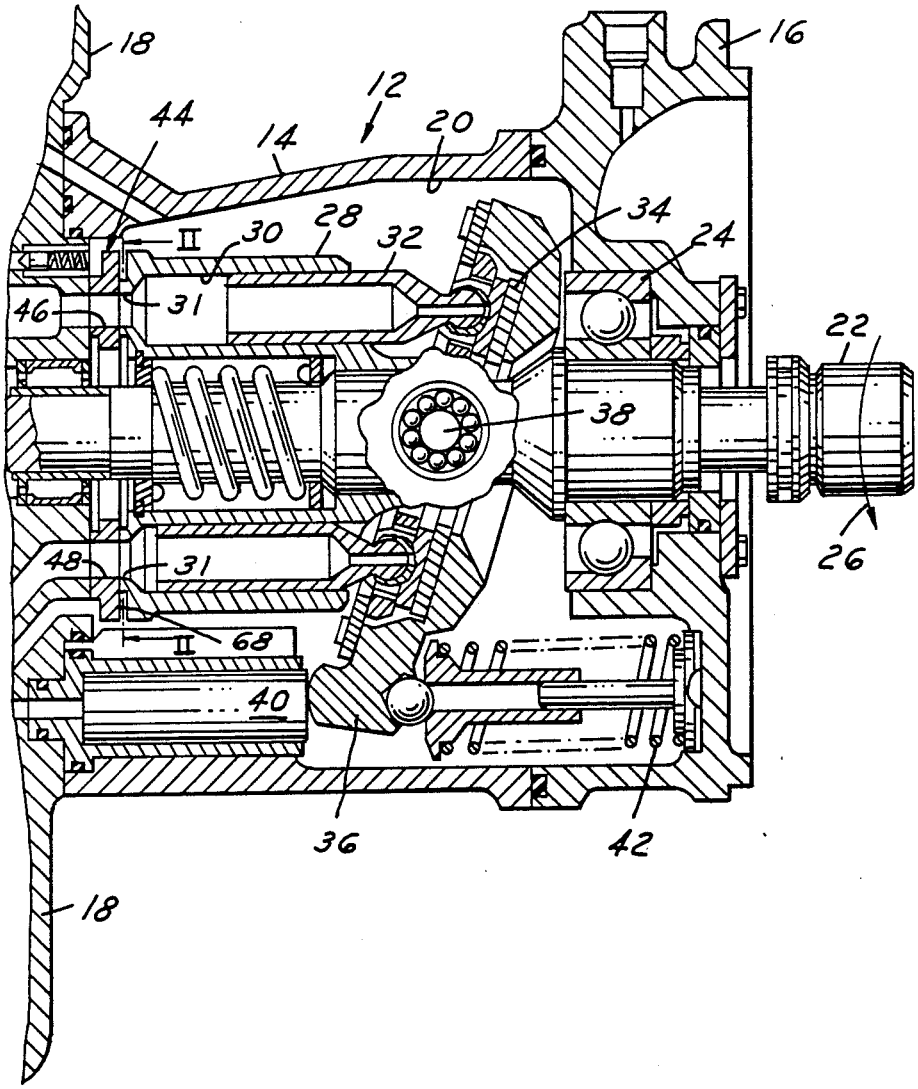

FIGS. 1A-1B illustrate an inline variable displacement piston pump 10 as comprising a case 12 including a hollow housing 14 having a mounting flange 16 and an adapter block 18 affixed to opposed ends thereof so as to form an open internal cavity 20. A pump drive shaft 22 is mounted by a bearing 24 for rotation within case 12 in a predetermined direction 26. A cylinder block 28 is affixed to shaft 22 for corotation therewith within cavity 20 and includes a plurality of cylinders 30 extending in a circumferential array around and parallel to the axis of rotation of shaft 22. A plurality of pistons 32 are respectively slidably disposed within corresponding cylinders 30 and have piston shoes 34 which slidably engage the opposing face of a yoke 36. Yoke 36 is variably positionable about a shaft 38 by a yoke actuator piston 40 acting against the force of the yokebiasing spring 42.

A valve plate 44 (FIG. 1B) is affixed to adapter block 18 and includes ports 46,48 for selectively connecting the cylinders 30 of block 28 to pump inlet 50 and pump outlet 52 as a function of cylinder block rotation. A valve block 54 (FIG. 1A) is mounted to adapter block 18 and carries a blocking valve 56 adjacent to outlet 52 and a solenoid valve 58 adjacent to a compensator valve 60 on adapter block 18. Solenoid valve 58 is controlled by external electronics (not shown) for connecting pump outlet pressure 52 to actuator piston 40, and thereby selectively demanding the minimum position of yoke 36 and pump displacement and also to actuate the blocking valve 56 to isolate the hydraulic circuit and pump.

Figure 2:
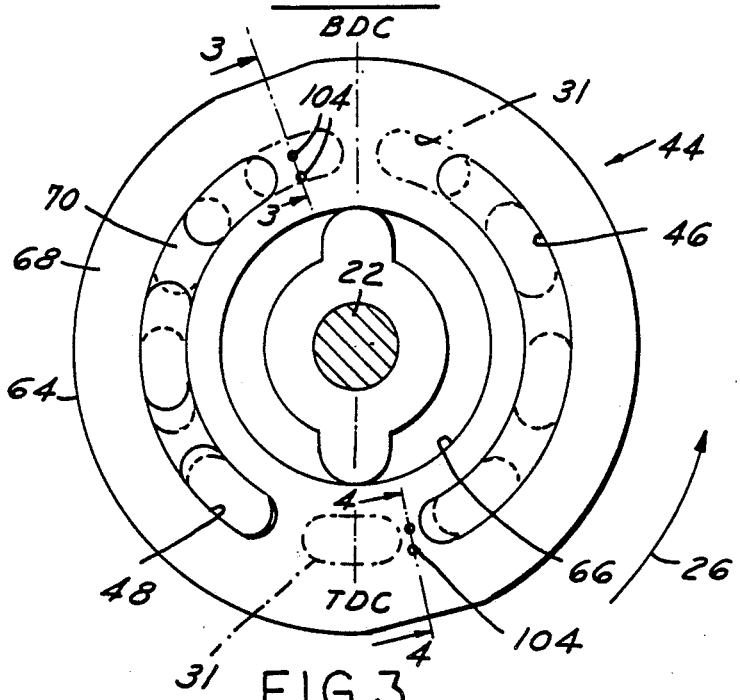
FIG. 2 is an elevational view of the valve plate assembly in FIG. 1B and is taken substantially along the line 2—2 in FIG. 1B.
Figure 3:
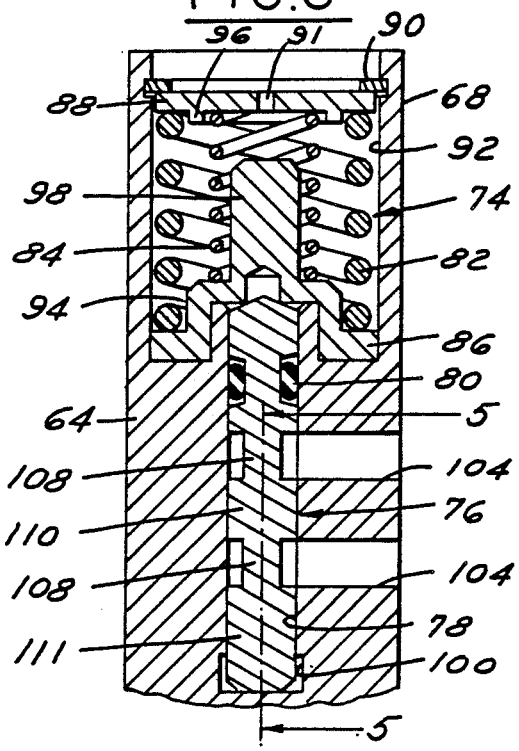
FIGS. 3 and 4 are fragmentary sectional views taken substantially along the lines 3—3 and 4—4 in FIG. 2.
Figure 4:
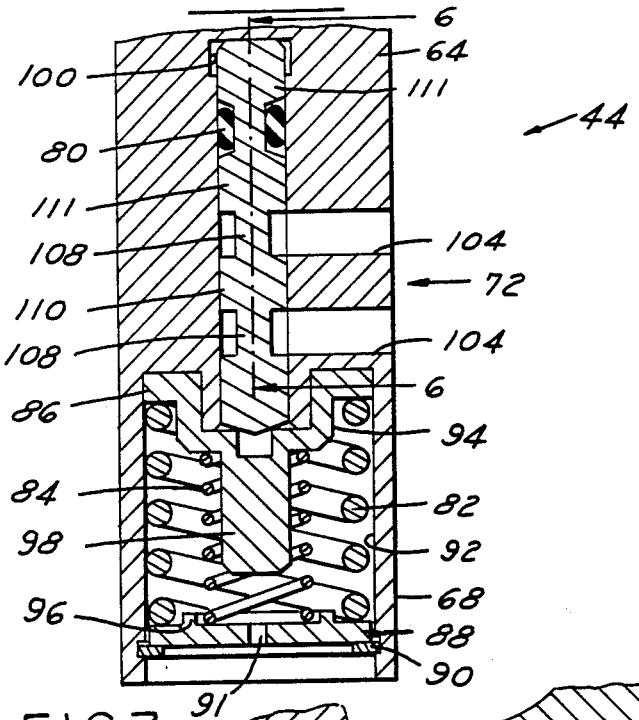

Valve plate 44 in accordance with the present invention comprises an assembly illustrated in greater detail in FIGS. 2-6. Valve plate assembly 44 includes a flat annular disc 64 of generally uniform thickness having a central opening 66 which surrounds shaft 22. Input and output valve plate openings 46,48 respectively comprise arcuate slots which extend around the axis of disc 64 and shaft 22 at a diameter which corresponds to the diameter of motion of the ports 31 of cylinders 30 (shown in phantom in FIG. 2) which engage the opposing flat face 68 of disc 64. As best seen in FIG. 2, arcuate slot 48, which is coupled to pump output port 52 (FIG. 1A) and thus forms the high-pressure plate slot, includes integral strengthening ribs 70. A pressure valve assembly 72,74 is carried by disc 64 circumferentially adjacent to the leading edges of respective slots 46,48 with reference to the direction 26 of rotation of cylinders 30 and ports 31 with respect to the valve plate assembly.

Valve 74 (FIGS. 3 and 5) comprises a valve spool 76 slidably carried within a cylindrical bore 78 opening radially outwardly of disc 64. An O-ring 80 is captured within a channel adjacent to the outer end of spool 76 for slidable sealing engagement with surrounding bore 78. A pair of coil springs 82,84 are coaxially captured in compression between a stepped keeper 86 carried by and engaging the outer end of valve spool 76, and a flat keeper disc 88 captured by the retaining ring 90 within the enlarged spring cavity 92 in plate disc 64. The ends of outer spring 82 are captured between the surrounding wall of spring cavity 92 and an opposing shoulder 94 on keeper 86 and a rib 96 on keeper disc 88. Inner spring 84 is captured within rib 96 and surrounds a central guide post 98 which integrally projects from keeper 86. A central orifice 91 in keeper disc 88 vents spring cavity 92 to case cavity 20 (FIG. 1B).

The inner end of bore 78 is enlarged to form the cavity 100 which is connected by the pilot fluid passage 102 (FIG. 5) to the adjacent edge of high-pressure slot 48. A pair of spaced parallel fluid passages 104 (FIGS. 2 and 3) extend from bore 78 to cylinder-engaging face 68 of valve plate disc 64. A second pair of spaced parallel fluid passages 106 (FIG. 5) extend from bore 78 to slot 48. Valve spool 76 has a pair of waists 108 separated by a land 110 and spaced from each other by the same distance as the separations between passages 104,106, which are identical. Waists 108 thus interconnect passages 104 and 106 when spool 76 is urged by springs 82,84 against the inner end or base of bore 78 and waists 108 register with passages 104,106 as shown in the drawings. On the other hand, land 110 between waists 108 and land 111 at the lower end of spool 76 are positioned on spool 76 so as to block fluid passage between each passage 104 and its associated passage 106 as spool 76 is moved (upwardly in FIGS. 3 and 5) against springs 82,84. The end of spool 76 within cavity 100 is tapered to admit fluid therebeneath.

Valve 72 is similar in construction to valve 74 hereinabove described in detail, with the exception that pilot fluid passage **102*a* (FIG. 6) extends from cavity 100*a* not to the adjacent low-pressure slot 46, but rather extends across plate disc 64 tangentially of the shaft axis to the opposing end of high-pressure slot 48. Other elements of valve 72 are identical in structure and function to corresponding elements of valve 74** and are indicated by correspondingly identical reference numerals in FIGS. 4 and 6.

In operation, valve spools 76 of valves 74,72 are initially urged by springs 82,84 to the positions shown in the drawings at which the spools open passages 104 to passages 106. The combination of passages 104,106 in valve 74 thus effectively extends the arcuate dimension of high-pressure slot 48 against or in opposition to the direction of motion 26. Thus, passages 104,106 effectively advance timing of fluid output from the pump cylinders. Stated differently, as cylinder ports 31 rotate in the direction 26 from the bottom dead center or BDC position (FIG. 2) with respect to plate 44, fluid within the cylinder is precompressed. However, such precompression is limited by registry of the cylinder port with passages 104 and fluid flow from the cylinder through passages 104,106 into slot 48. Likewise, passages 104,106 in valve 72 effectively enlarge the arcuate dimension of low-pressure input slot 46 in the direction opposed to cylinder motion, and thereby effectively advance timing of porting the cylinders to the low-pressure input port. That is, negative pressure increase within the cylinders prior to registry with slot 46 is limited by valve 72 and associated passages 104,106. Thus, under low output pressure conditions, high fluid velocities at the leading ends of slots 46,48 are avoided by effective extension thereof through valves 72,74.

As fluid pressure at pump output port 52 increases and fluid pressure within valve plate slot 48 correspondingly increases, increasing pressures within valve cavities 100 through pilot passages **102,102*a* urge spools 76 against forces applied by the opposing valve springs. It will be noted that transient output pressure variations are effectively damped by limited fluid flow at case pressure through orifices 91 in keepers 88. However, as steady-state output pressure increases, valve spools 76 are moved against the opposing springs until lands 110,111 effectively block flow between passages 104,106 in each valve 72,74. Thus, when fluid output pressure exceeds the threshold set by the valve springs, which threshold is preferably identical at each valve, pump timing is effectively retarded to timing corresponding to the dimensions of slots 46,48 per se. Dual pressure timing is thus provided in accordance with the invention. It will also be noted that gradual closure of valves 72,74** between low and high pressure conditions (and corresponding gradual opening as output pressure declines) effects gradual rather than abrupt changes in pump timing. Thus, although the valve plate assembly of the invention is designed specifically for timing at high and low sets of pressure conditions, intermediate conditions are also more readily accommodated than in fixed timing pumps of the prior art.

Thus, pump 10 is optimally timed for two pump outlet pressures (all other parameters remaining unchanged), which can be particularly beneficial on a pressure-scheduled or dual-range pressure-compensated pump. Recompression at lower operating pressure is reduced, thereby reducing pump wear, noise, pressure ripple, input power and cavitation. Such wear and cavitation reduction enhances pump life. Lower pressure ripple increases fatigue life in the complete hydraulic system. Reduced input power yields higher efficiency and lower heat rejection.

As noted above, the invention is not limited to variable-displacement in-line pumps, but applies equally as well to bent-axis and fixed displacement pumps, as well as analogous motion structures. The invention may be implemented at low cost. It will also be appreciated that the spool valves of the preferred embodiment respond to low frequency changes in outlet pressure, but not to differences between cylinder and port pressures. This reduces required bandwidth of the spool valves, and thereby diametrically reduces wear and fatigue problems.

Figure 7:
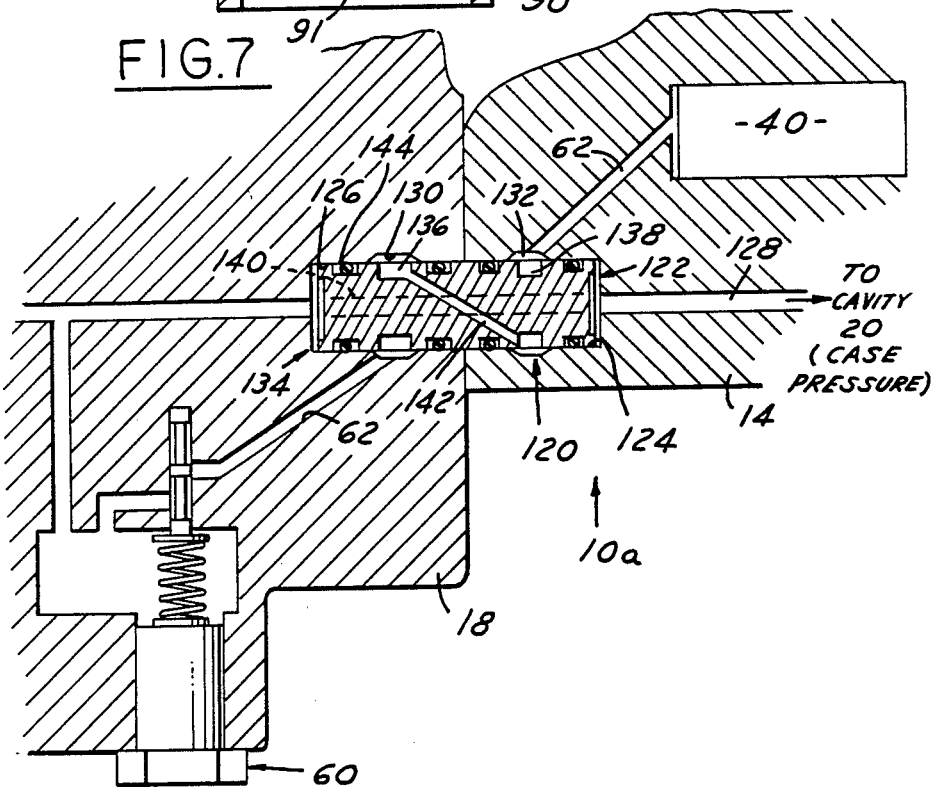
FIG. 7 is a fragmentary sectional view of a portion of the pump illustrated in FIGS. 1A-1B and showing a modification thereto in accordance with another aspect of the invention.
Figure 5:
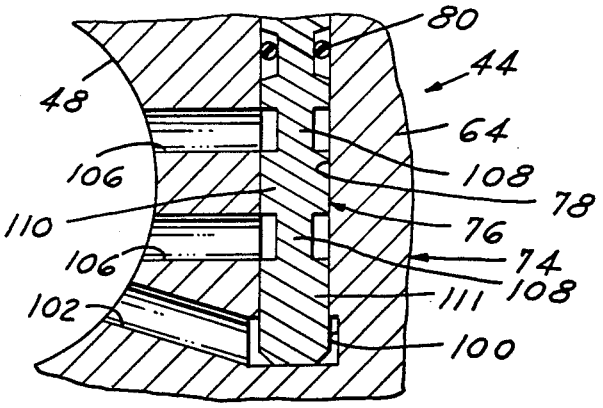
FIGS. 5 and 6 are fragmentary sectional views taken substantially along the lines 5—5 and 6—6 in FIGS. 3 and 4 respectively.
Figure 6:
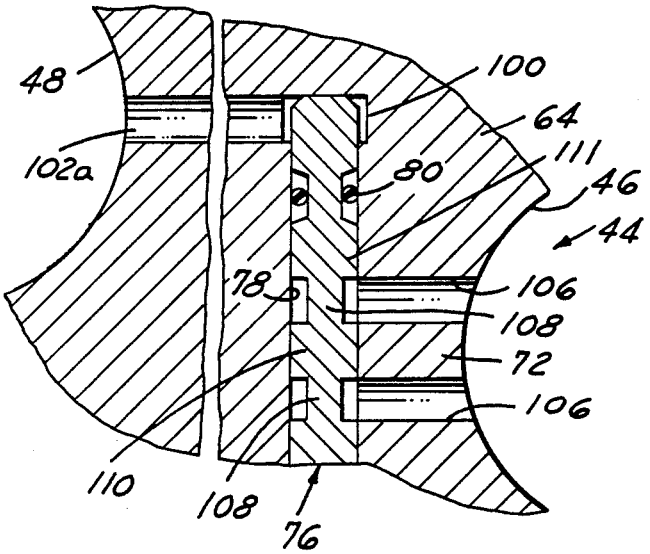

FIG. 7 illustrates a modified pump **10*a*, which is otherwise identical to the pump 10 of FIGS. 1-6, wherein a flow transfer assembly 120 is positioned within pilot control passage 62 between compensator valve 60 (shown schematically) and actuator piston 40, at the interface between housing 14 and adapter block 18, for reducing leakage between the case sections due to high-pressure conditions within the pilot passage. In particular, a cylindrical cavity 122 is formed perpendicularly of the planar interface between housing 14 and adapter block 18 by opposed cylindrical half-cavities 124,126 in the respective case sections. A fluid passage 128 within housing 14 connects cavity 122 to cavity 20 (FIG. 1B) at pump case pressure. An annular channel 130 is formed in adapter block 18 and opens into cavity section 126 approximately midway between the case section interface and the cavity section base. Likewise, an annular channel 132 is formed in housing 14 and opens into cavity section 124 midway between the interface and cavity base. Pilot passage 62 in adapter block 18 and housing 14 terminate within channels 130,132** respectively.

A hollow tubular sleeve 134 is captured within cavity 122 and has axially spaced channels 136,138 formed in the outer surface thereof at positions to register with channels 130,132 in adapter block 18 and housing 14 respectively. An internal passage 140 within sleeve 134 provides fluid flow at case pressure to compensator valve 60. An angulated passage 142 formed in sleeve 134 couples channels 136,138 to each other. O-rings 144 are captured within corresponding channels surrounding sleeve 134 on each side of channel 136, and again on each side of channel 138, and sealingly engage the opposing surfaces of channel sections 124,126 in housing 14 and adapter block 18. Thus, fluid at pilot pressure is fed from compensator valve 60 through channels 130,136, through passage 142 to channels 132,138, and then through passage 62 in housing 14 to piston 40. However, the forces applied by the pilot fluid against adapter block 18 and housing 14 are substantially radial adjacent to the block/housing interface. Axial forces at the interface are at case pressure which remains substantially constant. Thus, the tendency of the case sections to separate at the interface is substantially reduced.

The invention claimed is:

1. A rotary hydraulic machine comprising a housing, a shaft mounted within said housing for rotation in a predetermined direction about a shaft axis, cylinder means coupled to said shaft for corotation therewith within said housing and including a cylinder having a cavity parallel to said axis, piston means including a piston disposed in said cylinder cavity, high and low pressure fluid ports in said housing, and valve plate means for selectively porting said cylinder means to said fluid ports, said valve plate means comprising a valve plate affixed within said housing and having first and second diametrically opposed arcuate slots respectively coupled to said high and low pressure fluid ports, said slots being at a radius from said axis corresponding to the radius of said cylinder cavity from said axis and having arcuate ends at positions for timing porting of said cylinder to said ports at preselected pressure condition at said ports, and means for altering port timing as a function of pressure at said high pressure port comprising:

first and second pressure valves mounted on said plate adjacent to respective leading edges of said first and second slots with respect to said predetermined direction of rotation, each said valve including a valve element responsive to pressure in said first slot for connecting said cylinder means to the adjacent said slot and thereby advancing port timing of said cylinder to said ports, each of said first and second valves comprising a cylindrical bore opening radially outwardly of said plate, a pilot port extending through said plate and coupling said first slot to a radially inner end of said bore, a pair of valve ports respectively extending from said bore to the adjacent said slot and to a face of said plate engaged by said cylinder means, said valve element comprising a valve spool having a land for selectively interconnecting said valve ports as a function of spool position, and spring means captured in compression against a radial outer end of said spool, said plate being mounted in said machine within a cavity containing hydraulic fluid at case pressure, each said spring means being disposed within a valve cavity ported through a damping orifice to case pressure, said housing comprising first and second housing sections sealingly affixed to each other, at least one fluid passage extending between said sections, said machine further comprising a cylindrical cavity formed by opposed cavity half-sections in said housing sections, means connecting said cylindrical cavity to fluid at case pressure, an annular channel in each said housing section surrounding and opening into the associated said cavity half-sections, said at least one fluid passage in each said housing section terminating in the associated said channel, and a hollow tubular sleeve captured within said cylindrical cavity, said sleeve having outwardly facing annular channels opposite to said channels in said housing sections, means coupling said outwardly facing channels to each other and means sealingly engaging opposed wall sections to said cylindrical cavity.

2. A rotary hydraulic machine comprising a housing including first and second housing sections sealingly affixed to each other, at least one fluid passage extending between said sections, a shaft mounted within said housing for rotation in a predetermined direction about a shaft axis, cylinder means coupled to said shaft for corotation therewith within said housing and including a cylinder having a cavity parallel to said axis, piston means including a piston disposed in said cylinder cavity, high and low pressure fluid ports in said housing, and valve plate means for selectively porting said cylinder means to said fluid ports, characterized in that said machine further comprises a cylindrical cavity formed by opposed cavity half-sections in said housing sections, means connecting said cylindrical cavity to fluid at case pressure, an annular channel in each said housing section surrounding and opening into the associated said cavity half-sections, said at least one fluid passage in each said housing section terminating in the associated said channel, and a hollow tubular sleeve captured within said cylindrical cavity, said sleeve having outwardly facing annular channels opposite to said channels in said housing sections, means coupling said outwardly facing channels to each other and means sealingly engaging opposed wall sections to said cylindrical cavity.

3. A rotary hydraulic machine comprising a housing, a shaft mounted within said housing for rotation in a predetermined direction about a shaft axis, cylinder means coupled to said shaft for corotation therewith within said housing and including a cylinder having a cavity parallel to said axis, piston means including a piston disposed in said cylinder cavity, high and low pressure fluid ports in said housing, and valve plate means for selectively porting said cylinder means to said fluid ports, said valve plate means comprising a valve plate affixed within said housing in a cavity containing hydraulic fluid at case pressure and having first and second diametrically opposed arcuate slots respectively coupled to said high and low pressure fluid ports, said slots being at a radius from said axis corresponding to the radius of said cylinder cavity from said axis and having arcuate ends at positions for timing porting of said cylinder to said ports at preselected pressure condition at said ports, and means for altering port timing as a function of pressure at said high pressure port comprising:

first and second pressure valves mounted on said plate adjacent to respective leading edges of said first and second slots with respect to said predetermined direction of rotation, each said valve including a valve element responsive to pressure in said first slot for connecting said cylinder means to the adjacent said slot and thereby advancing port timing of said cylinder to said ports, each of said first and second valves comprising a cylindrical bore opening radially outwardly of said plate, a pilot port extending through said plate and coupling said first slot to a radially inner end of said bore, a pair of valve ports respectively extending from said bore to the adjacent said slot and to a face of said plate engaged by said cylinder means, said valve element comprising a valve spool having a land for selectively interconnecting said valve ports as a function of spool position, and spring means captured in compression against a radial outer end of said spool, said plate being mounted in said machine within a cavity containing hydraulic fluid at case pressure, each said spring means being disposed within a valve cavity ported through a damping orifice to case pressure.

4. A rotary hydraulic machine comprising a housing, a shaft mounted within said housing for rotation in a predetermined direction about a shaft axis, cylinder means coupled to said shaft for corotation therewith within said housing and including a cylinder having a cavity parallel to said axis, piston means including a piston disposed in said cylinder cavity, high and low pressure fluid ports in said housing, and valve plate means for selectively porting said cylinder means to said fluid ports, said valve plate means comprising a valve plate affixed within said housing in a cavity containing hydraulic fluid at case pressure and having first and second diametrically opposed arcuate slots respectively coupled to said high and low pressure fluid ports, said slots being at a radius from said axis corresponding to the radius of said cylinder cavity from said axis and having arcuate ends at positions for timing porting of said cylinder to said ports at preselected pressure condition at said ports, and means for altering port timing as a function of pressure at said high pressure port comprising:

first and second pressure valves mounted on said plate adjacent to respective leading edges of said first and second slots with respect to said predetermined direction of rotation, each said valve including a valve element responsive to pressure in said first slot for connecting said cylinder means to the adjacent said slot and thereby advancing port timing of said cylinder to said ports, each of said first and second valves comprising a cylindrical bore opening radially outwardly of said plate, a pilot port extending through said plate and coupling said first slot to a radially inner end of said bore, a pair of valve ports respectively extending from said bore to the adjacent said slot and to a face of said plate engaged by said cylinder means, said valve element comprising a valve spool having a land for selectively interconnecting said valve ports as a function of spool position, keeper means secured adjacent to a radially outer end of said bore, spring means captured in compression between said keeper means and a radial outer end of said spool, and a fluid orifice in said keeper means venting that portion of said bore surrounding said spring to case pressure.

5. The machine set forth in claim 4 wherein each said keeper means comprises a keeper disc and means removably securing said disc adjacent to said radially outer end of the associated said bore.

6. The machine set forth in claim 5 wherein each said valve further comprises a stepped keeper skirt engaging an associated said valve spool, each said spring means comprising a first coil spring captured between said keeper disc and a peripheral shoulder on said keeper skirt, and a second coil spring coaxial with said first spring captured between said keeper disc and said keeper skirt, each said keeper skirt including a central guide post extending into the associated said second coil spring.

7. The machine set forth in claim 6 wherein each said keeper disc includes an annular rib positioned between the associated said springs.

* * * * *